US007494361B2

(12) United States Patent
Ho

(10) Patent No.: US 7,494,361 B2
(45) Date of Patent: Feb. 24, 2009

(54) CARD EDGE CONNECTOR

(75) Inventor: Yi-Tse Ho, Tainan Hsien (TW)

(73) Assignee: Molex Corporation, Lisle, IL (US)

( * ) Notice: Subject to any disclaimer, the term of this patent is extended or adjusted under 35 U.S.C. 154(b) by 0 days.

(21) Appl. No.: 11/801,198

(22) Filed: May 8, 2007

(65) Prior Publication Data

US 2007/0270004 A1 Nov. 22, 2007

(30) Foreign Application Priority Data

May 9, 2006 (TW) ..... 95207926 U

(51) Int. Cl.
*H01R 13/62* (2006.01)

(52) U.S. Cl. ..... 439/326; 439/260; 439/92

(58) Field of Classification Search ..... 439/62, 439/64, 92, 136, 260, 325–329, 630
See application file for complete search history.

(56) References Cited

U.S. PATENT DOCUMENTS 5,632,640 A * 5/1997 Noda ..... 439/326
6,953,369 B2 * 10/2005 Sasaki et al. ..... 439/680
7,074,067 B2 * 7/2006 Yang et al. ..... 439/326
2006/0094277 A1 * 5/2006 Yang et al. ..... 439/328
2007/0238344 A1 * 10/2007 Ho ..... 439/260
2007/0270004 A1 * 11/2007 Ho ..... 439/136

* cited by examiner

*Primary Examiner*—James Harvey
(74) *Attorney, Agent, or Firm*—Robert J. Zeitler

(57) ABSTRACT

A card edge connector that allows the insertion of an electric card includes an insulating body, a plurality of terminals, and two metallic pieces. Each of the two metallic pieces includes a substrate, an elastic arm connected to the substrate, and a locking portion connected to the upper edge of the free end of the elastic arm. The locking portion has a curved bottom surface and a smooth bottom surface. The smooth bottom surface is adjacent to the curved bottom surface. When locked, the curved bottom surface of the locking portion presses and locks the electric card. When the curved bottom surface loosens due to vibrations of the electric card, the smooth bottom surface of the locking portion presses and locks the electric card firmly. Therefore, the locking effect is increased, and the electric card is prevented from loosening and bounding upwardly.

17 Claims, 7 Drawing Sheets

CARD EDGE CONNECTOR

FIELD OF THE INVENTION

The present invention relates to a card edge connector, and in particular to a card edge connector provided on the upper surface of a circuit board that allows an electric card to be inserted therein.

BACKGROUND OF THE INVENTION

A conventional card edge connector is provided on the upper surface of a circuit board and allows an electric card to be inserted therein, thereby electrically connecting the circuit board and the electric card. Taiwan Patent Publication No. 382836 (Application No. 86118731) published on Feb. 21, 2000 discloses an electrical connector having a metallic latch, which includes a dielectric casing and a latching element having a latch piece. The latch piece of the latching element can be locked to the upper surface of the electric card, thereby preventing an upward bound of the electric card. In this way, the electric card can be inserted on the dielectric casing stably.

Although the above card edge connector is provided with the latch piece for locking the electric card, the latch piece is a curved piece that is prone to loosening due to the vibrations of the electric card. Thus, the locking effect of the latch piece is insufficient to press and lock the electric card positively. As a result, the electric card is prone to loosening and bounding upwardly so that the electric card cannot be inserted onto the insulating body firmly. The proposed invention overcomes the above problems.

SUMMARY OF THE INVENTION

The primary object of the present invention is to provide a card edge connector in which the locking portion of the metallic piece can press and lock the electric card positively, thereby increasing the locking effect and preventing the electric card from becoming loose and bounding upwardly.

In order to achieve the above object, the present invention provides a card edge connector, which includes an insulating body having an insertion slot; a plurality of terminals provided on the upper and lower edges of the insertion slot of the insulating body, each terminal having a contact portion and a pin portion, the contact portion being located in the insertion slot, the pin portion extending beyond the insulating body; and two metallic pieces. Each metallic piece comprises a substrate fixedly provided on both sides of the insulating body; an elastic arm connected to the substrate, the front end of the elastic arm being formed with a free end; and a locking portion connected to the upper edge of the free end of the elastic arm. The locking portion has a curved bottom surface and a smooth bottom surface. The smooth bottom surface is adjacent to the curved bottom surface near one side of the free end of the elastic arm.

The advantages of the present invention lies in that the locking portion of the metallic piece is provided with a smooth bottom surface. The smooth bottom surface is adjacent to one side of the curved bottom surface. When locking, the curved bottom surface of the locking portion presses and locks the electric card. When the curved bottom surface is loosened due to the vibration of the electric card, the rear end of the electric card is raised so that it becomes inclined. At this time, the smooth bottom surface of the locking portion is brought into contact with the electric card. The smooth bottom surface increases the friction force, thereby generating a larger friction force between the locking portion and the electric card. Therefore, the locking effect is increased, preventing the electric card from becoming loose and bounding upwardly.

In order to better understand the characteristics and technical contents of the present invention, a detailed description thereof will be made with reference to the accompanying drawings. However, it should be understood that the drawings and the description are illustrative but not used to limit the scope of the present invention.

DETAILED DESCRIPTION OF THE INVENTION

Figure 1:
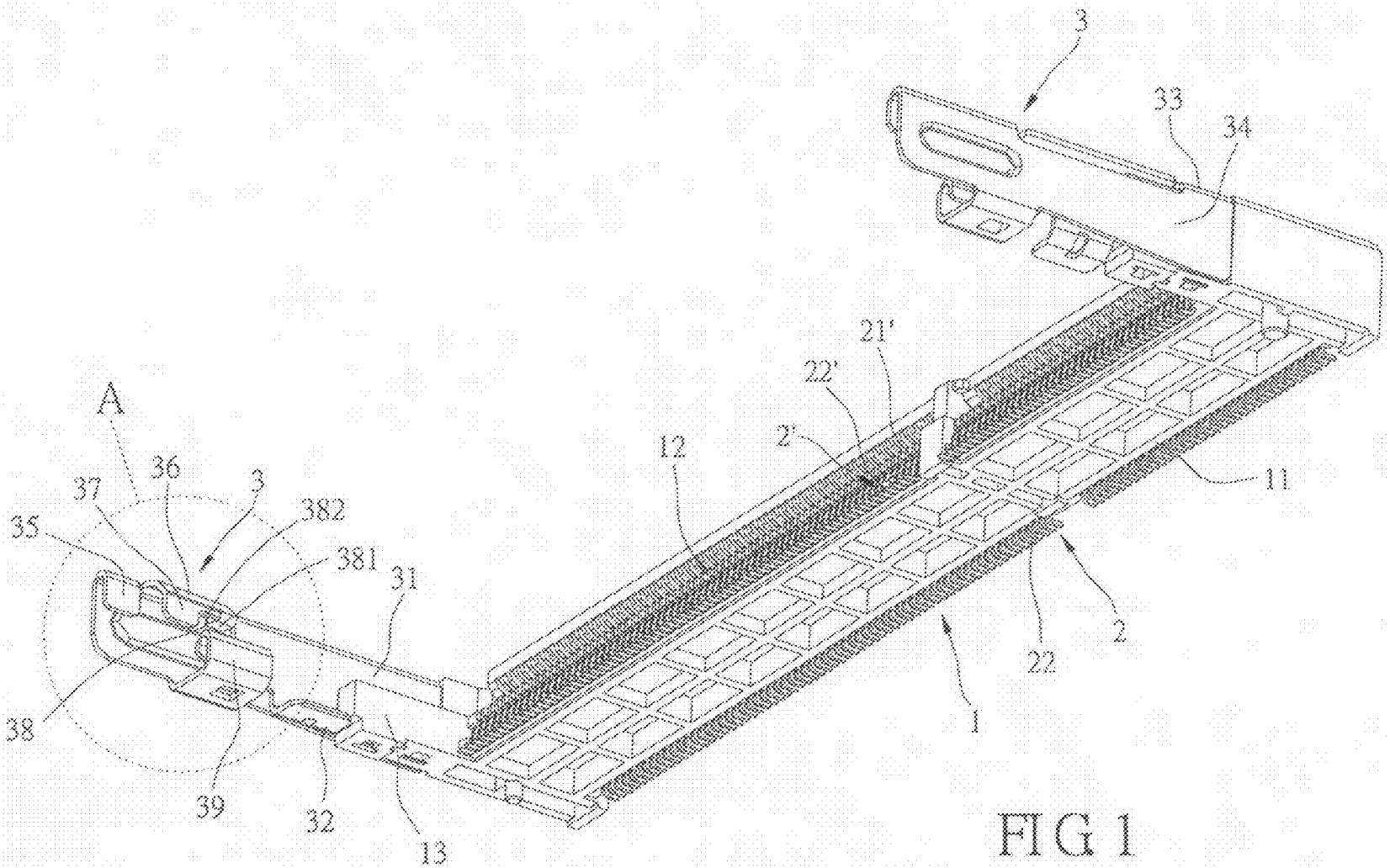
FIG. 1 is a perspective view showing the card edge connector of the present invention.
Figure 1A:
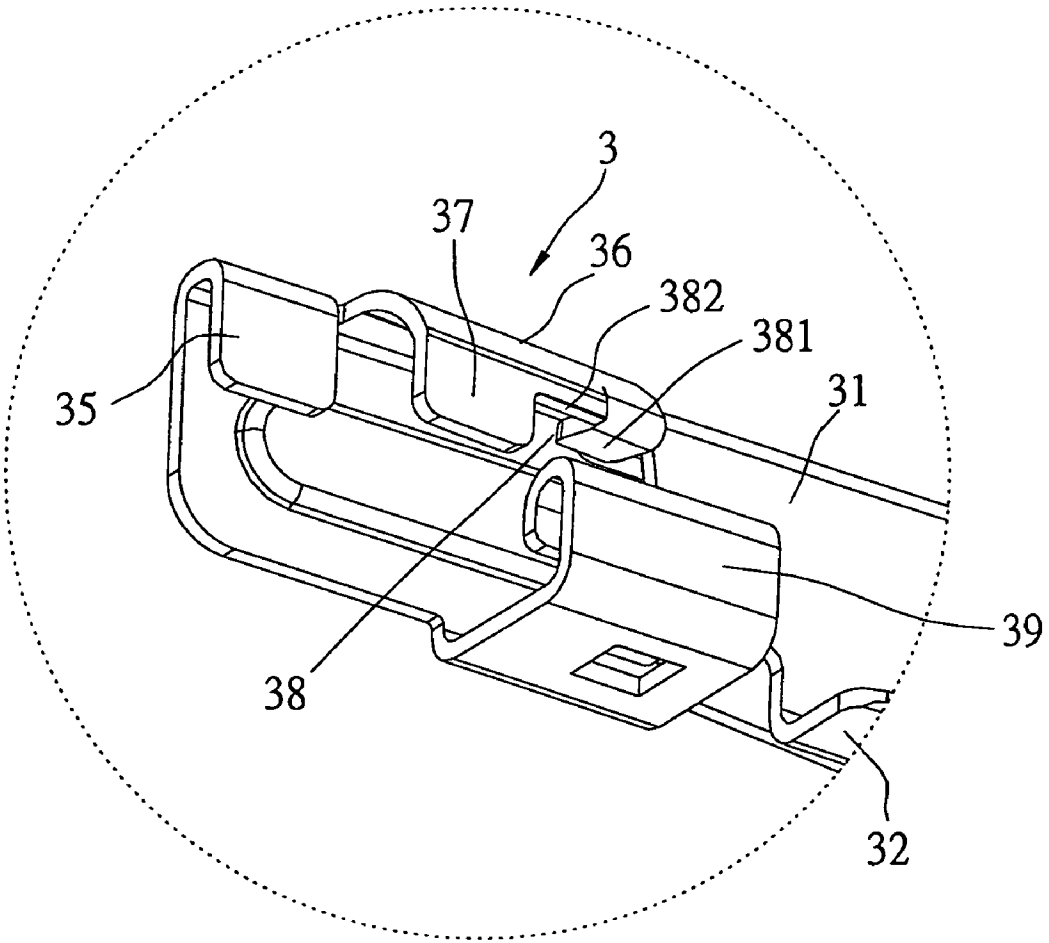
FIG. 1A is a schematic view showing the details of the portion A of FIG. 1.
Figure 2A:
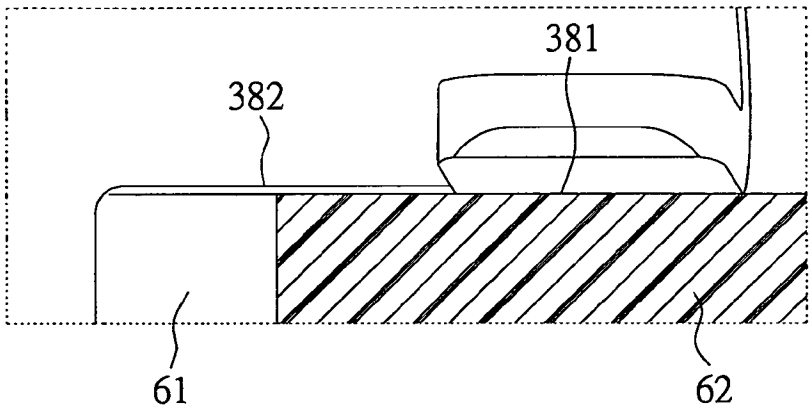
FIG. 2A is a schematic view showing the details of the portion A of FIG. 2.
Figure 2:
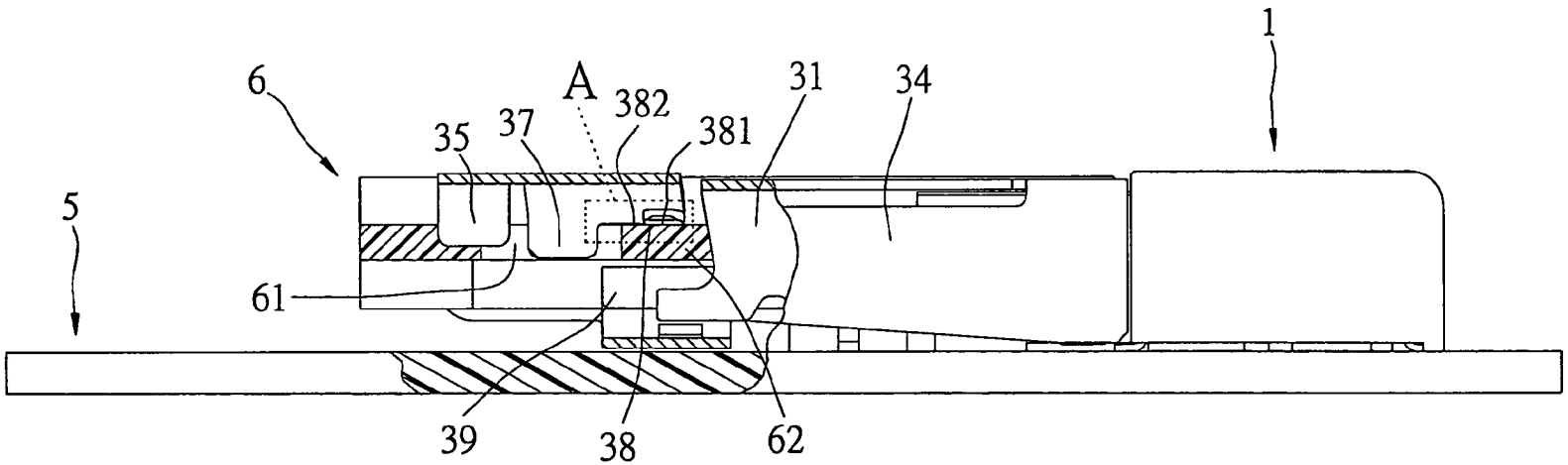
FIG. 2 is a cross-sectional view showing the card edge connector of the present invention, an electric card and a circuit board.
Figure 3:
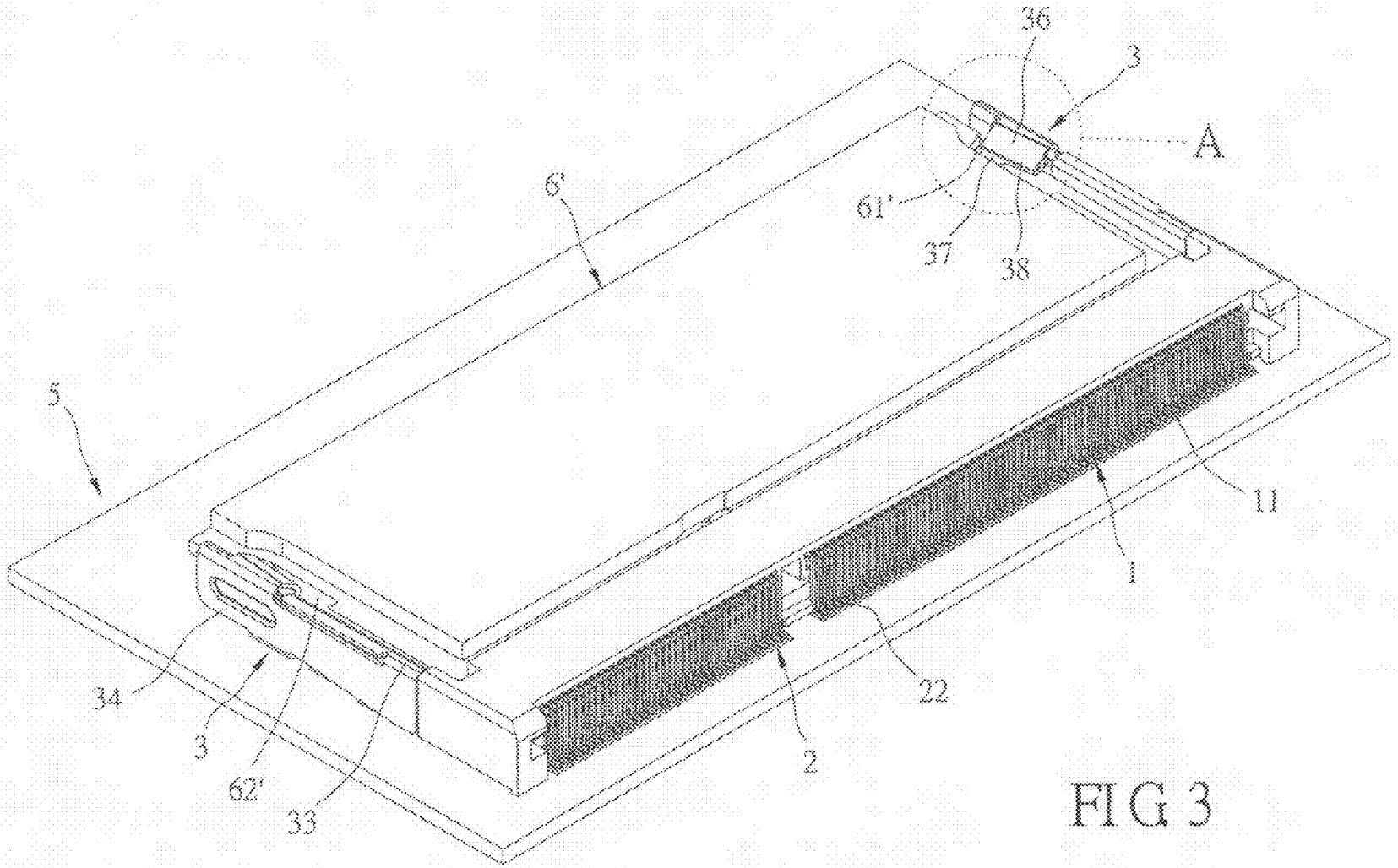
FIG. 3 is a perspective view showing another state of the card edge connector of the present invention, an electric card and a circuit board.
Figure 3A:
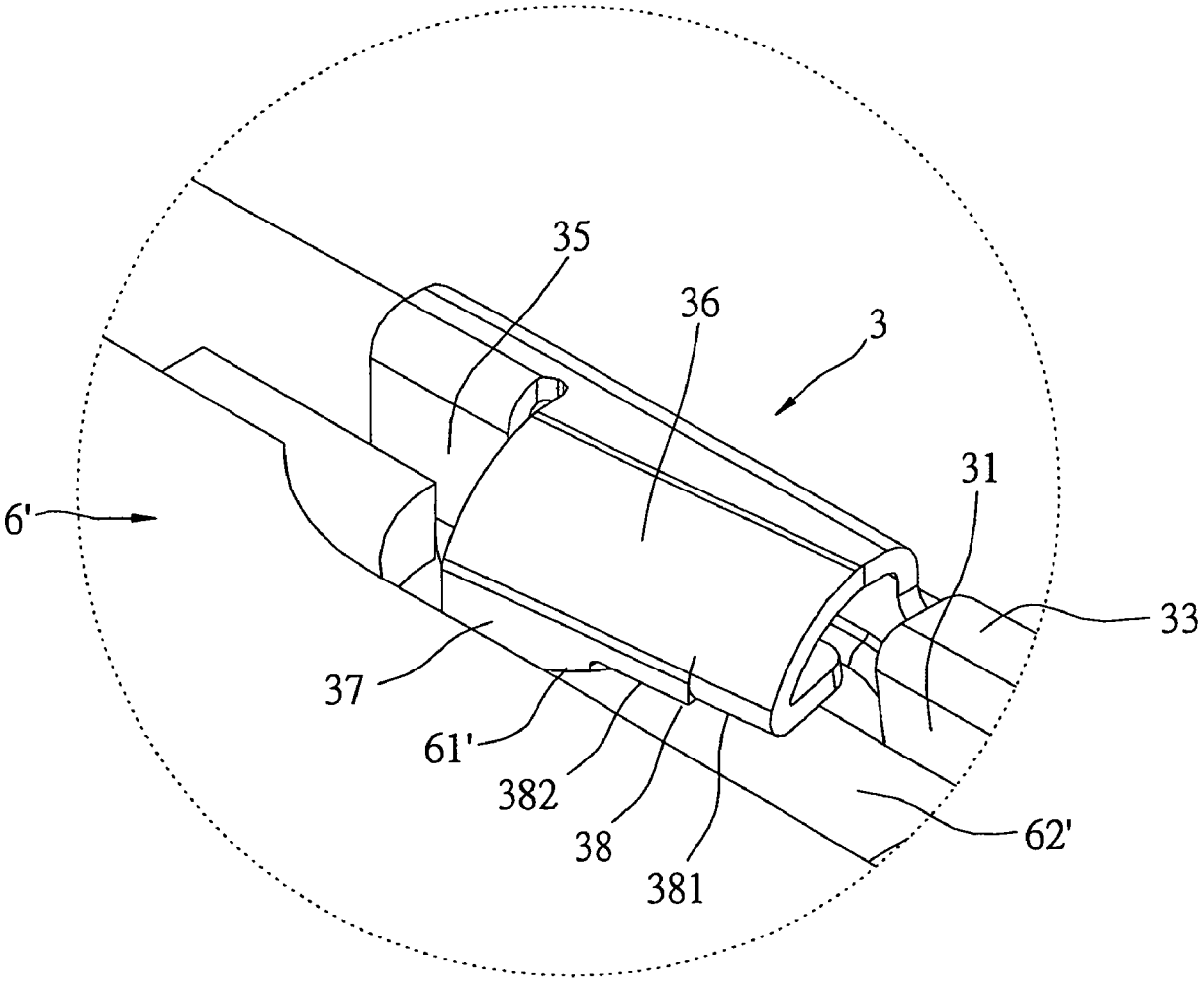
FIG. 3A is a schematic view showing the details of the portion A of FIG. 3.
Figure 4A:
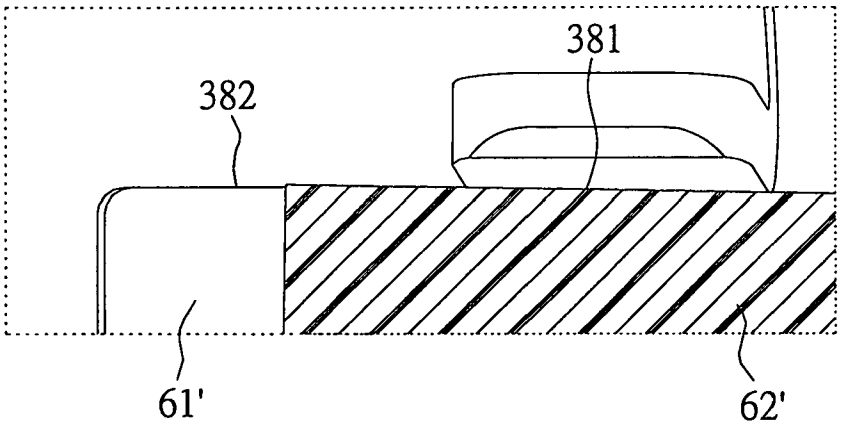
FIG. 4A is a schematic view showing the details of the portion A of FIG. 4.
Figure 4:
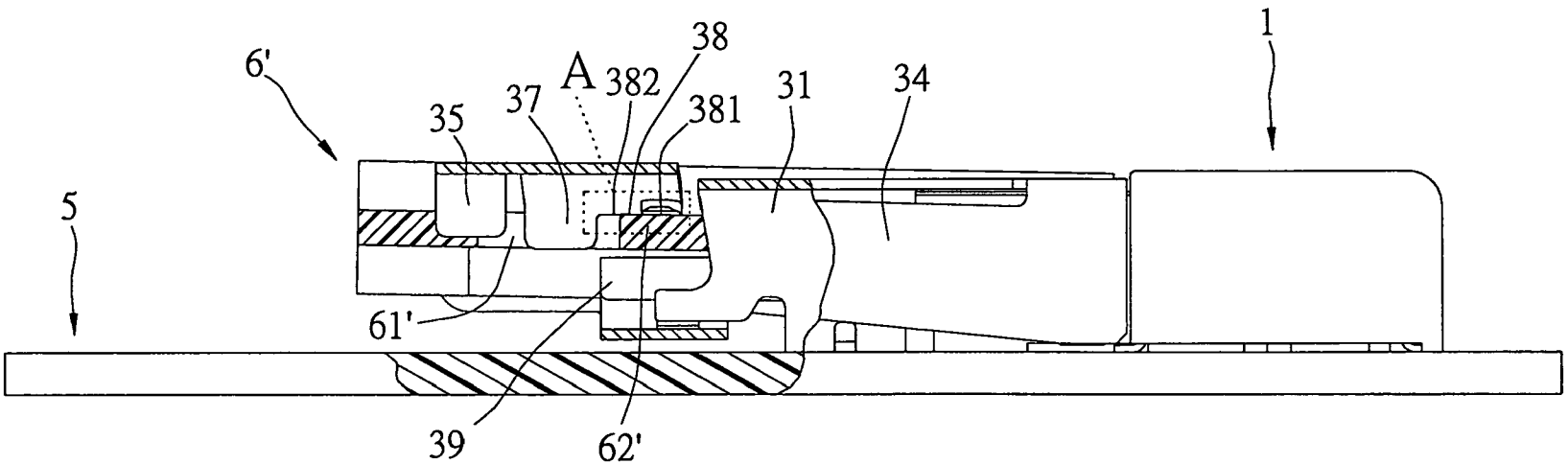
FIG. 4 is a perspective view showing another state of the card edge connector of the present invention, an electric card and a circuit board.
Figure 5:
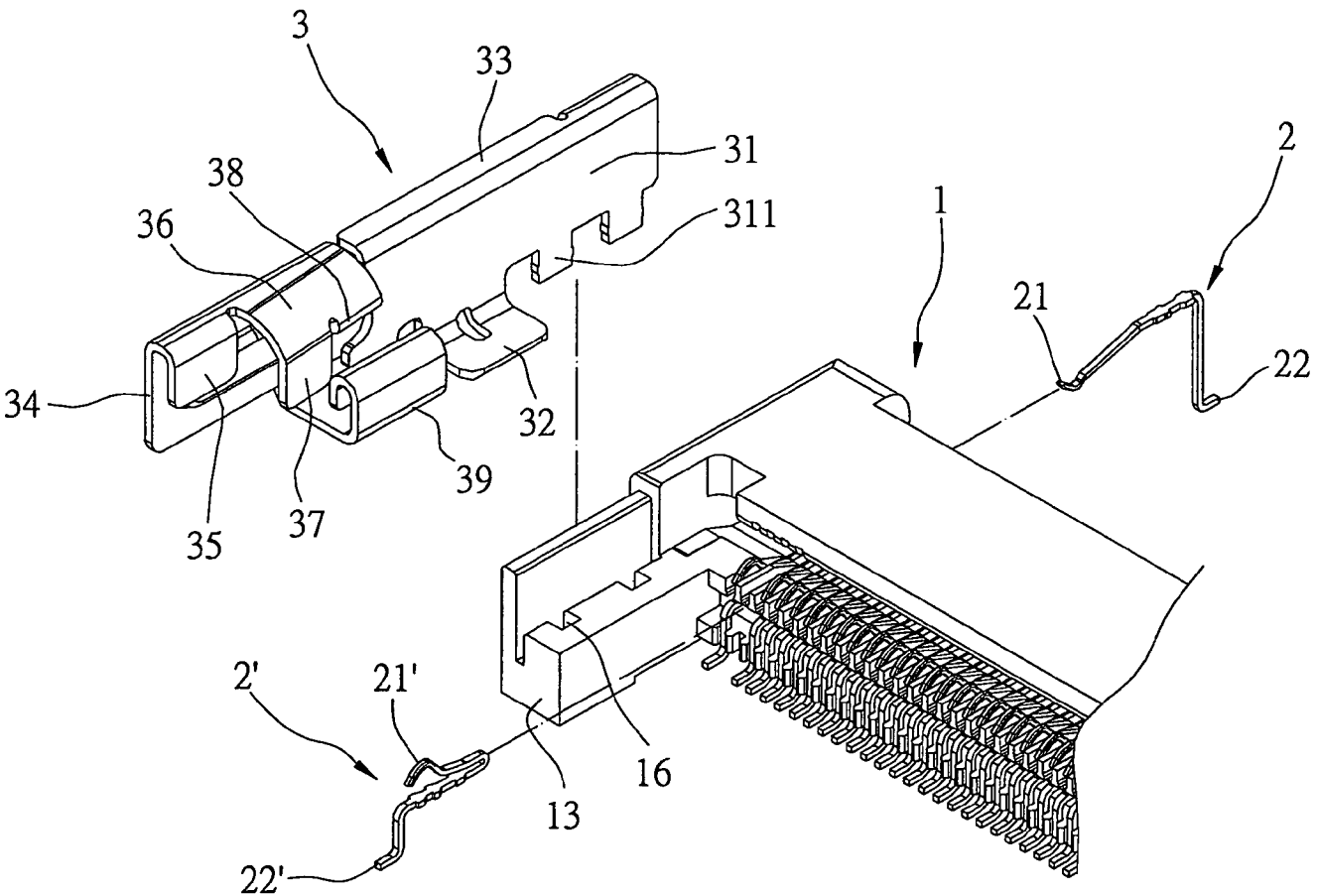
FIG. 5 is an exploded perspective view showing a portion of the card edge connector of the present invention.

Please refer to FIGS. 1, 1A, 2 and 2A, in which the present invention of a card edge connector is shown. The card edge connector is provided on an upper surface of a circuit board 5 and allows an electric card 6 to be inserted therein, thereby electrically connecting the circuit board 5 and the electric card 6. The card edge connector comprises an insulating body 1, a plurality of terminals 2, 2' and two metallic pieces 3. The insulating body 1 is made of plastic materials and has a body portion 11. The body portion 11 is provided thereon with an elongated insertion slot 12 that allows the electric card 6 to be inserted therein. A fixing block 13 extends from both sides of the body portion 11 respectively. The two fixing blocks 13 are blocks protruding from the front side of the body portion 11. Each of the two fixing blocks 13 is formed thereon with two insertion holes 16, as shown in FIG. 5.

The terminals 2, 2' are provided on the body portion 11 of the insulating body 1. The terminals 2, 2' are provided in an upper row and a lower row that are provided on the upper and lower edges of the insertion slot 12 respectively. Each of the terminals 2, 2' has a contacting portion 21,21' and a pin portion 22, 22'. The contacting portion 21,21' is located within the insertion slot 12 for electrically contacting the electrical contacts of the electric card 6. The pin portion 22, 22' extends beyond the body portion 11 for electrically connecting with the electrical contacts of the circuit board 5.

The two metallic pieces 3 are made of metallic materials by means of pressing. From an upper position, the two metallic pieces 3 are mounted downwardly on the two fixing blocks 13. Each of the two metallic pieces 3 has a substrate 31, a welded portion 32, a top plate 33, an elastic arm 34, a turning portion 35, a guiding portion 36, an engaging portion 37, a locking portion 38 and a supporting portion 39. The substrate 31 is an upright plate. The lower edge of the substrate 31 extends downwardly to form two insertion pieces 311 that are positioned near the rear end thereof and correspond to the insertion holes 16. From an upper position, the two metallic pieces 3 are mounted downwardly on the two fixing blocks 13, so that the two insertion pieces 311 of the lower edge of the substrate 31 are inserted and fixed into the two corresponding insertion holes 16 of the insulating body 1, thereby mounting the two metallic pieces 3 on the insulating body 1 stably.

The welded portion 32 extends horizontally and inwardly from the lower edge of the substrate 31. The welded portion 32 can be welded and fixed on the circuit bard 5 to electrically connect the metallic piece 3 with the circuit board 5. The top plate 33 extends from the upper edge of the substrate 31 horizontally and outwardly. The top plate 33 is an elongated plate.

The elastic arm 34 extends downwardly and forwardly from the outer edge of the top plate 33 and is positioned near the rear end thereof. The elastic arm 34 is connected to the substrate 31 via the top plate 33. The elastic arm 34 is an elongated upright plate. The front end of the elastic arm 34 is formed into a free end. The free end of the elastic arm 34 protrudes from the front end of the fixing block 13 of the insulating body 1 by a proper length.

The turning portion 35 and the guiding portion 36 extend inwardly and downwardly from the upper edge of the free end of the elastic arm 34. The turning portion 35 helps to turn the elastic arm 34 to move outwardly so that the engaging portion 37 and the locking portion 38 can be detached from the electric card 6, thereby ejecting the electric card 6 smoothly. The guiding portion 36 is located behind the turning portion 35 and is bent into a curved shape so as to guide the electric card 6 to be pressed into position.

The engaging portion 37 is an upright plate. The upper edge of the engaging portion 37 is connected to the upper edge of the free end of the elastic arm 34. The engaging portion 37 can be used to engage with corresponding notches 61 of both sides of the electric card 6 so that the electric card 6 cannot move forwards or backwards. The locking portion 38 extends from the lower edge of the guiding portion 36. The locking portion 38 is located behind the engaging portion 37. The locking portion 38 has a curved bottom surface 381 and a smooth, i.e. flat, bottom surface 382. The smooth bottom surface 382 is adjacent to the curved bottom surface 381 near one side of the free end of the elastic arm 34. The curved bottom surface 381 can be pressed and locked on the upper surface of the plate body 62 of the electric card 6. The smooth bottom surface 382 is a smooth, i.e. flat, plane that is located on a higher level than that of the curved bottom surface 381 so that the curved bottom surface 381 can be used to press and lock the electric card when it is locked. Alternatively, the smooth bottom surface 382 can be located on the same level as that of the curved bottom surface 381 so that the curved bottom surface 381 and the smooth bottom surface 382 can press and lock the electric card collectively.

The supporting portion 39 bends and extends inwardly from the lower edge of the elastic arm 34. The supporting portion 39 can be used to block the lower surface of the plate body 62 of the electric card 6. With the above structure, the card edge connector of the present invention is formed.

The card edge connector of the present invention can be provided on the circuit board 5 and allows the electric card 6 to be inserted into the insulating body 1 so that the electrical contacts of the electric card 6 can be electrically connected with the circuit board 5 via the terminals 2, 2' within the insertion slot 12. When the electric card 6 is inserted into the insulating body 1, the engaging portions 37 of the two metallic pieces 3 engage with the notches 61 of both sides of the electric card 6, thereby blocking the electric card 6 from moving forwards or backwards and preventing the electric card 6 becoming detached from the insertion slot 12. The curved bottom surface 381 of the locking portions 38 of the two metallic pieces 3 are press-fitted to the upper surface of the plate 62 of the electric card 6, thereby stabilizing the insertion of the electric card 6. The supporting portions 39 of the two metallic pieces 3 are used to block the lower surface of the plate body 62 of the electric card 6, thereby preventing the electric card 6 from displacing downwardly.

When the electric card 6 is to be removed, the turning portions 35 of the two metallic pieces 3 are used to turn the elastic arms 34 to move outwardly, so that the engaging portions 37 are detached from the notches 61 of both sides of the electric card 6. At the same time, the curved bottom surfaces 381 of the locking portions 38 are detached from the electric card 6, thereby allowing the electric card 6 to be removed easily.

The advantage of present invention lies in that, the locking portion 38 of the metallic piece 3 is further provided with a smooth bottom surface 382. The smooth bottom surface 382 is adjacent to one side of the curved bottom surface 381. The smooth bottom surface 382 can be located on a higher level than that of the curved bottom surface 381. When locked, the curved bottom surface 381 of the locking portion 38 presses and locks the electric card 6. The smooth curved shape of the curved bottom surface 381 can reduce the interference generated when the circuit board 6 is pressed. When the curved bottom surface 381 is loosened due to the vibrations of the electric card, as shown in FIGS. 3, 3A, 4 and 4A, the rear end of the electric card 6' is raised and becomes inclined. At this time, the smooth bottom surface 382 of the locking portion 38 contacts the front edge of the notch 61' on the upper surface of the plate body 62' of the electric card 6'. The smooth bottom surface 382 increases the friction force, so that a larger friction force can be generated between the locking portion 38 and the upper surface of the plate body 62' of the electric card 6'. As a result, the electric card 6' can be pressed and locked firmly thereby increasing the locking effect and preventing the elastic arm 34 and the locking portion 38 from displacing outwardly that may cause the electric card 6' to loosening and bounding upwardly.

Although the present invention has been described with reference to the foregoing preferred embodiment, it will be understood that the invention is not limited to the details thereof. Various equivalent variations and modifications may occur to those skilled in this art in view of the teachings of the present invention. Thus, all such variations and equivalent modifications are also embraced within the scope of the invention as defined in the appended claims.

What is claimed is:

1. A card edge connector, comprising:

an insulating body having an insertion slot;

a plurality of terminals provided on the upper and lower edges of the insertion slot of the insulating body, each terminal having a contacting portion and a pin portion, the contact portion being located in the insertion slot, the pin portion extending beyond the insulating body; and two metallic pieces each comprising a substrate fixedly provided on both sides of the insulating body, an elastic arm connected to the substrate, a front end of the elastic arm being formed into a free end, the elastic arm having a length extending from the insulating body to the free end, and a locking portion connected to an upper edge of the free end of the elastic arm, wherein the locking portion has a curved bottom surface and a flat bottom surface, the flat bottom surface and the curved bottom surface are adjacent to one another along the length of the elastic arm.

2. The card edge connector according to claim 1, wherein both sides of the insulating body are provided with a fixing block respectively, and the substrates of the two metallic pieces are fixedly provided on the fixing blocks of both sides of the insulating body.

3. The card edge connector according to claim 1, wherein the flat bottom surface of the locking portion of the two metallic pieces is located on a higher level than that of the curved bottom surface.

4. The card edge connector according to claim 1, wherein the flat bottom surface of the locking portion of the two metallic pieces is located on the same level as that of the curved bottom surface.

5. The card edge connector according to claim 2, wherein insertion pieces extend downwardly from the lower edge of the substrate of the two metallic pieces, the two fixing blocks of the insulating body are provided with corresponding insertion holes, and the insertion pieces are inserted and fixed into the corresponding insertion holes of the fixing blocks.

6. The card edge connector according to claim 1, wherein each of the two metallic pieces has a welding portion, and the welding portion is formed by means of extending from the lower edge of the substrate.

7. The card edge connector according to claim 1, wherein each of the two metallic pieces has a top plate, the top plate is formed by means of extending outwardly from the upper edge of the substrate, and the elastic arm is formed by means of extending downwardly and forwardly from the outer edge of the top plate and is positioned near the rear end thereof.

8. The card edge connector according to claim 1, wherein each of the two metallic pieces has a turning portion, and the turning portion is formed by means of extending inwardly and downwardly from the free end of the elastic arm.

9. The card edge connector according to claim 1, wherein each of the two metallic pieces has a guiding portion formed by means of extending inwardly and downwardly from the upper edge of the free end of the elastic arm, and a locking portion connected to the lower edge of the guiding portion.

10. The card edge connector according to claim 1, wherein each of the two metallic pieces has an engaging portion, the engaging portion is an upright plate, and the upper edge of the engaging portion is connected to the upper edge of the free end of the elastic arm.

11. The card edge connector according to claim 1, wherein the terminals are provided on upper and lower edges of the insertion slot.

12. The card edge connector according to claim 1, wherein the elastic arm includes a supporting portion extending therefrom in the same direction that the locking portion extends therefrom.

13. The card edge connector according to claim 1, wherein the flat bottom surface is positioned between the curved bottom surface and the free end of the elastic arm.

14. A card edge connector, comprising:

an insulating body having an insertion slot;

a plurality of terminals provided on the upper and lower edges of the insertion slot of the insulating body, each terminal having a contacting portion and a pin portion, the contact portion being located in the insertion slot, the pin portion extending beyond the insulating body; and two metallic pieces each comprising a substrate fixedly provided on both sides of the insulating body, an elastic arm connected to the substrate, a front end of the elastic arm being formed into a free end, and a locking portion connected to an upper edge of the free end of the elastic arm, wherein the locking portion has a curved bottom surface and a flat bottom surface, the flat bottom surface are adjacent to the curved bottom surface near one side of the free end of the elastic arm, the flat bottom surface of the locking portion of the two metallic pieces is located on the same level as that of the curved bottom surface.

15. A card edge connector, comprising:

an insulating body having an insertion slot;

a plurality of terminals provided on the upper and lower edges of the insertion slot of the insulating body, each terminal having a contacting portion and a pin portion, the contact portion being located in the insertion slot, the pin portion extending beyond the insulating body; and two metallic pieces each comprising a substrate fixedly provided on both sides of the insulating body, an elastic arm connected to the substrate, a front end of the elastic arm being formed into a free end, and a locking portion connected to an upper edge of the free end of the elastic arm, wherein the locking portion has a curved bottom surface and a flat bottom surface, the flat bottom surface are adjacent to the curved bottom surface near one side of the free end of the elastic arm, each of the two metallic pieces has a top plate, the top plate is formed by means of extending outwardly from the upper edge of the substrate, and the elastic arm is formed by means of extending downwardly and forwardly from the outer edge of the top plate and is positioned near the rear end thereof.

16. A card edge connector, comprising:

an insulating body having an insertion slot;

a plurality of terminals provided on the upper and lower edges of the insertion slot of the insulating body, each terminal having a contacting portion and a pin portion, the contact portion being located in the insertion slot, the pin portion extending beyond the insulating body; and two metallic pieces each comprising a substrate fixedly provided on both sides of the insulating body, an elastic arm connected to the substrate, a front end of the elastic arm being formed into a free end, and a locking portion connected to an upper edge of the free end of the elastic arm, wherein the locking portion has a curved bottom surface and a flat bottom surface, the flat bottom surface are adjacent to the curved bottom surface near one side of the free end of the elastic arm, each of the two metallic pieces has a turning portion, and the turning portion is formed by means of extending inwardly and downwardly from the free end of the elastic arm.

17. A card edge connector, comprising:

an insulating body having an insertion slot;

a plurality of terminals provided on the upper and lower edges of the insertion slot of the insulating body, each terminal having a contacting portion and a pin portion, the contact portion being located in the insertion slot, the pin portion extending beyond the insulating body; and two metallic pieces each comprising a substrate fixedly provided on both sides of the insulating body, an elastic arm connected to the substrate, a front end of the elastic arm being formed into a free end, and a locking portion connected to an upper edge of the free end of the elastic arm, wherein the locking portion has a curved bottom surface and a flat bottom surface, the flat bottom surface are adjacent to the curved bottom surface near one side of the free end of the elastic arm, each of the two metallic pieces has a guiding portion formed by means of extending inwardly and downwardly from the upper edge of the free end of the elastic arm, and a locking portion connected to the lower edge of the guiding portion.

* * * * *